US009808052B1

(12) United States Patent
Mouzakis, III

(10) Patent No.: US 9,808,052 B1
(45) Date of Patent: Nov. 7, 2017

(54) TOOL FOR MANIPULATING SPLIT RINGS

(71) Applicant: George Edward Mouzakis, III, Naples, FL (US)

(72) Inventor: George Edward Mouzakis, III, Naples, FL (US)

( * ) Notice: Subject to any disclaimer, the term of this patent is extended or adjusted under 35 U.S.C. 154(b) by 0 days.

(21) Appl. No.: 15/598,946

(22) Filed: May 18, 2017

Related U.S. Application Data

(60) Provisional application No. 62/338,379, filed on May 18, 2016.

(51) Int. Cl.
*A44B 15/00* (2006.01)
*B25B 33/00* (2006.01)

(52) U.S. Cl.
CPC ..... *A44B 15/007* (2013.01); *B25B 33/00* (2013.01)

(58) Field of Classification Search
CPC ..... A44B 15/007; B25B 33/00; B25B 9/00; B25B 9/02; B25B 27/00; B25B 27/08; B25B 27/20; B25B 27/205; B25B 27/30
See application file for complete search history.

(56) References Cited

U.S. PATENT DOCUMENTS 1,176,793 A * 3/1916 Tuttle ..... B21D 39/034 29/21.1
1,541,695 A * 6/1925 Faucher et al. ..... B25B 27/08 29/248
1,810,631 A * 6/1931 Trump ..... A01K 35/00 29/235
2,562,128 A * 7/1951 Sawdy ..... B25B 27/20 29/224
3,055,244 A * 9/1962 Snook ..... A44C 5/02 30/258
4,149,435 A 4/1979 Smith
4,325,273 A 4/1982 Gibbons
4,602,536 A 7/1986 Fish
5,174,117 A 12/1992 Naito et al.
5,207,014 A 5/1993 Panella
5,515,587 A 5/1996 Pool
5,839,141 A * 11/1998 Hermann ..... A01K 97/00 7/106
6,035,748 A 3/2000 Burch, Jr.
D439,817 S * 4/2001 Lehmann ..... D8/52
6,860,130 B2 3/2005 Brantschem
7,448,301 B1 * 11/2008 Cronin ..... B25B 27/205 29/229
7,654,177 B1 * 2/2010 Cronin ..... B25B 27/205 7/125
9,156,150 B2 10/2015 Wang
(Continued)

*Primary Examiner* — David B Thomas
(74) *Attorney, Agent, or Firm* — Dunlap, Bennett & Ludwig PLLC

(57) ABSTRACT

A hand tool adapted to manipulate and open split rings is provided. The hand tool has two elements both having handles operatively associated so that the distal end jaw portions of the elements are movable between a closed and an open position. An opening jaw has a penetrating probe for opening convolution of a split ring, while the opposing supporting jaw provides a supporting surface acting as an anvil providing opposing force to the other linear elements probe. The split ring is generally disposed around the spaced apart opposing jaws, permitting the probe to penetrate the convolutions over a deeper range because there is no limitation created by the opposing jaw.

9 Claims, 15 Drawing Sheets

(56) References Cited

U.S. PATENT DOCUMENTS

| | | | | |
|---|---|---|---|---|
| 9,475,181 | B2 * | 10/2016 | Kim, Il | B25B 7/02 |
| 2007/0000358 | A1 * | 1/2007 | Sakai | B25B 27/205 81/426 |
| 2008/0041197 | A1 | 2/2008 | Lalond | |
| 2009/0235705 | A1 | 9/2009 | Knapton | |
| 2010/0043605 | A1 | 2/2010 | Konkel | |
| 2015/0298310 | A1 * | 10/2015 | Cronin | B25F 1/003 7/132 |

* cited by examiner

TOOL FOR MANIPULATING SPLIT RINGS

CROSS-REFERENCE TO RELATED APPLICATION

This application claims the benefit of priority of U.S. provisional application No. 62/338,379, filed 18 May 2016, the contents of which are herein incorporated by reference.

BACKGROUND OF THE INVENTION

The present invention relates to hand tools and, more particularly, to hand tools adapted to manipulate and open split rings.

Split rings are a common contrivance used to flexibly retain objects having an eye or opening through which one of the convolutions of the split ring may be threaded through. Said split ring serves as a link between said eye and an attaching device. A common example is a key ring which normally does not represent a problem to an operator because the combination of its size and elasticity permits most individuals to be able to mount keys without difficulty. There are situations, however, involving typically smaller split rings where a tool facilitates safer, less awkward and speedier manipulation of said split rings. Some of these manipulations present special issues involving combinations of safety, small size, and rings constructed of material exhibiting high values of Young's modulus.

Terminal fishing tackle is a case in point. Various governmental and environmental organizations focusing on conserving the environment encourage and sometimes specify that the actual hooks—whatever their design—be composed of materials that will disintegrate over time after exposure to water and other oxidizing agents. The purpose of this requirement is to ensure that hooks abandoned in fish and the occasional unfortunate bird will decay and eventually free the animal of the abandoned hook. Consequently, fishing lures normally possess a life that is a large multiple of that of typical hooks attached to same. Further, lures are far more expensive than the replaceable hook they employ. Fisherman treasure those lures which they feel provide them with the most success: they are extremely reluctant to abandon said lures simply because the hooks are short lived. The fisherman's affinity for his lures as well as their initial expense motivates many anglers to maintain their fishing lures over the life of numerous hooks. Maintenance of said lures and their associated hooks—particularly treble hooks—is awkward, hazardous and time consuming.

As can be seen, there is a need for a hand tool adapted to manipulate and open split rings that is easier and safer than the prior art.

SUMMARY OF THE INVENTION

In one aspect of the present invention, a device for spreading apart adjacent convolutions of a split ring includes a pair of jaws which are movable between a closed and an open position; one of said jaws having a supporting surface; and the other of said jaws having a protrusion with a wedge edge or point adapted as the jaws are moved from the closed to the open position to pass between the convolutions of a split ring engaging the supporting surface, wherein the pair of jaws occupy a position in an opening of the split ring. In certain embodiments further including a supporting wall defined by the one of said jaws so that the supporting wall is generally perpendicular to the supporting surface, wherein the supporting surface is removably attachable to the one of said jaws, and wherein the protrusion faces away from a center of said opening.

In another aspect of the present invention, a method of spreading apart adjacent convolutions by using the above-mentioned device includes the steps of placing the pair of jaws within said opening, securing the split ring by pivotally moving said jaws toward the open position until the supporting surface engages and the protrusion engage generally opposing portions of an inner diameter of the opening; and pivotally moving said jaws further to the open position so that the wedge edge or point passes between the adjacent convolutions of the split ring.

In yet another aspect of the present invention, a device for spreading apart adjacent convolutions of a split ring includes a pair of jaws which are pivotally movable between an open and a closed position; one of said jaws having an arcuate supporting surface; and the other of said jaws having a protrusion with a wedge edge or point adapted as the jaws are pivotally moved from the open to the closed position to pass between the convolutions of a split ring supported on the supporting surface. In certain embodiments further including bookending sidewalls defined by the arcuate supporting surface recessed in the one of said jaws, and a circumferential ridge protruding from the arcuate supporting surface, wherein the circumferential ridge is adapted to encounter a convolution eye of the split ring supported thereon, and wherein the pair of jaws move with a parallel pivot action so that in the protrusion and the supporting surface are oriented in a collinear relationship with each other in both the open and the closed position.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a hand tool adapted to manipulate and open split rings. The hand tool has two linear elements both having handles operatively associated so that the distal end jaw portions of the linear elements are movable between a closed and an open position. An opening jaw has a penetrating probe for opening convolution of a split ring, while the opposing supporting jaw provides a supporting surface acting as an anvil providing opposing force to the other linear elements probe. The split ring is generally disposed between the spaced apart opposing jaws, permitting the probe to penetrate the convolutions over a deeper range because there is no limitation created by the opposing jaw.

Referring to FIGS. 1 through 32B, the present invention may include hand tools 100 adapted to manipulate and open split rings. It should be understood by those skilled in the art that the use of directional terms such as upper, lower, upward, downwardly, top and the like are used in relation to the illustrative embodiments as they are depicted in the figures, the upward direction (or upper) being toward the top of the corresponding figures and a downward direction being toward the bottom of the corresponding figure.

Figure 1:
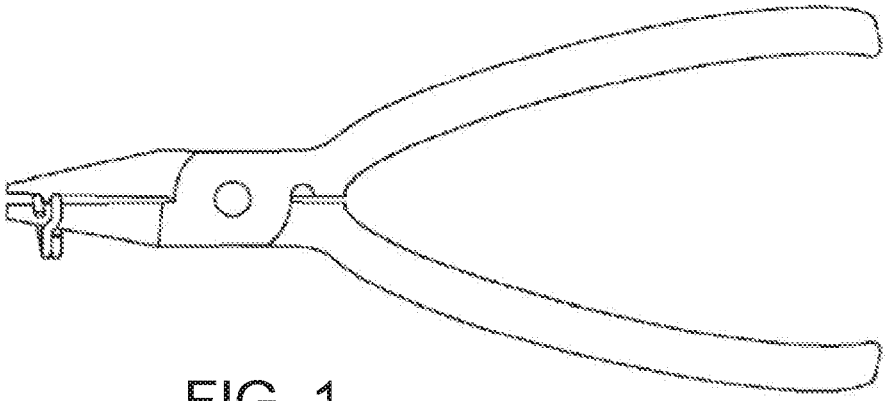
FIG. 1 (PRIOR ART)
FIG. 1 is a side elevation view of an exemplary prior art.
Figure 2:
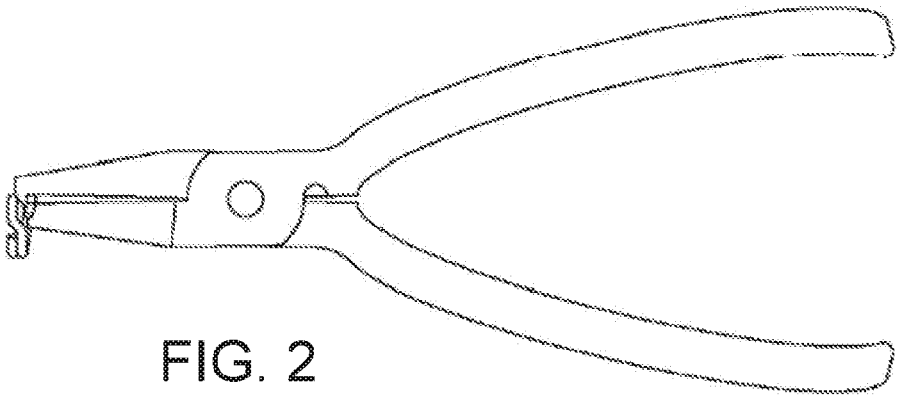
FIG. 2 (PRIOR ART)
FIG. 2 is a side elevation view of an exemplary prior art.
Figure 3:
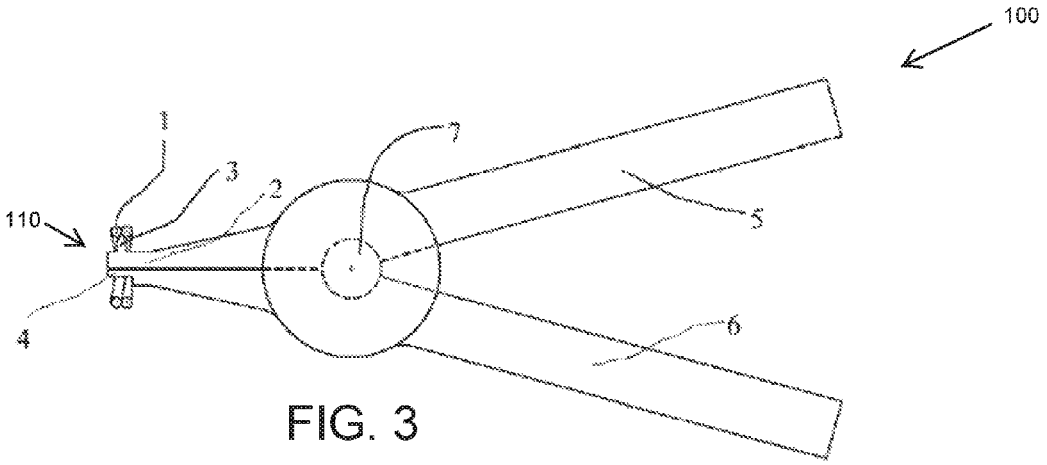
FIG. 3 is a side elevation view of an exemplary embodiment of the present invention, shown in use in a closed position.
Figure 4:
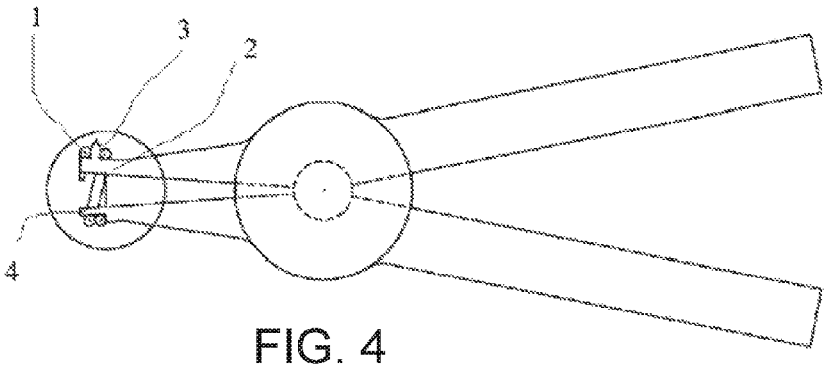
FIG. 4 is a side elevation view of an exemplary embodiment of the present invention, shown in use in an open position.
Figure 5:
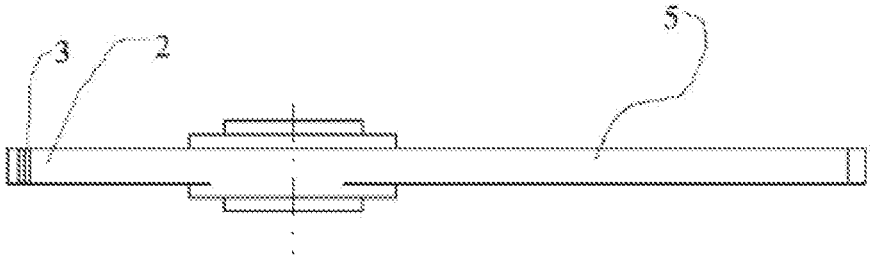
FIG. 5 is a top plan view of an exemplary embodiment of the present invention.
Figure 6:
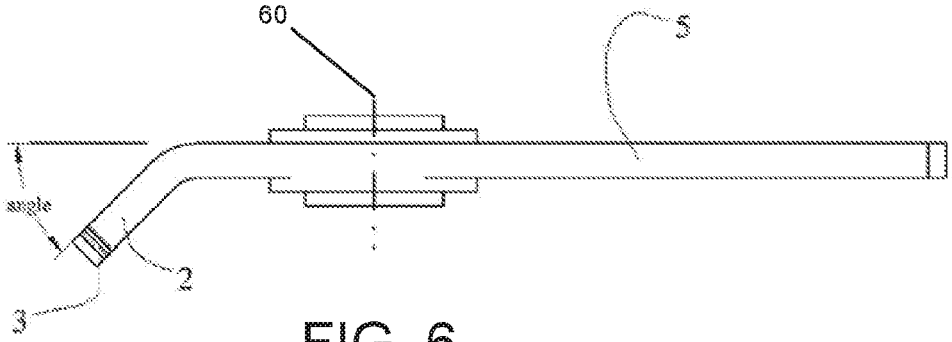
FIG. 6 is a top plan view of an exemplary embodiment of the present invention.
Figure 7:
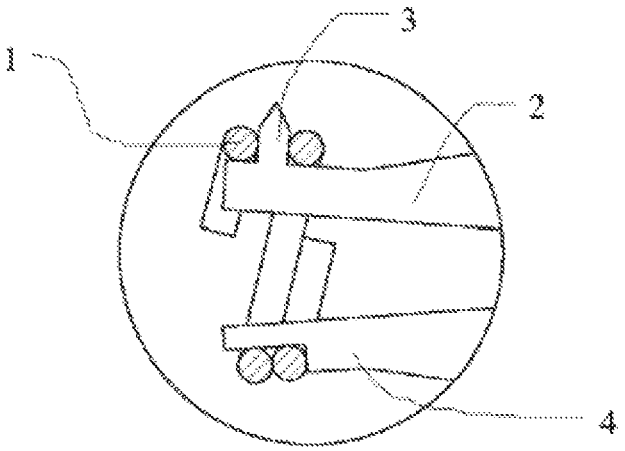
FIG. 7 is a detail side elevation view of a working end of the exemplary embodiment of the present invention of FIG. 4 shown in use in the open position.

Referring to FIGS. 1 through 10, the hand tools 100 include a first embodiment 110 having a pair of elongated handles 5 and 6 that are pivotally interconnected between their opposite ends by a pivot pin 7 establishing a pivotal axis 60 for relative pivotal movement of the handles 5 and 6. The handles 5 and 6 provide a pair of jaws 2 and 4, respectfully. The first embodiment 110 of the hand tool 100 may provide an upward protrusion 3 transversely extending from the opening jaw 2, wherein the upward protrusion 3 terminates in a tapered wedge edge 73 or point 75, and wherein the wedge edge/point 73/75 is adapted to pass between the convolutions of the split ring 1. The supporting jaw 4 provides a downwardly supporting surface 78 facing in an opposite direction of the upward protrusion 3. In certain embodiments, the pair of jaws 2 and 4 may be bent along an angle relative to the handle portions, as illustrated in FIG. 6.

The first embodiment 110 engages the split ring 1 solely from its interior or inside diameter: holding, stabilizing and opening two convolutions of the split ring 1. The opening jaw 2 with its protruding feature 3 cooperates with the supporting jaw 4. The jaw movement is, via respective jaw handles 5 and 6, operating through the pivot 7. The first embodiment 110 needs only one jaw, the opening jaw 2, to engage the upward protrusion 3 at the split ring manipulation point or "convolution eye." The convolution eye is the recessed area between the confronting surfaces of contiguous convolutions or turns, wherein lateral, spreading movement of the protrusion wedge tip 73 or point 75 as the jaws enter the opened position "opens" the split ring 1.

As a result, the first embodiment 110 does not have the probe restrictions that conjoining jaws generate, and can therefore accommodate a greater range of split ring diameters and wire gauges than allowed by the same probe operating within the prior art.

Figure 8:
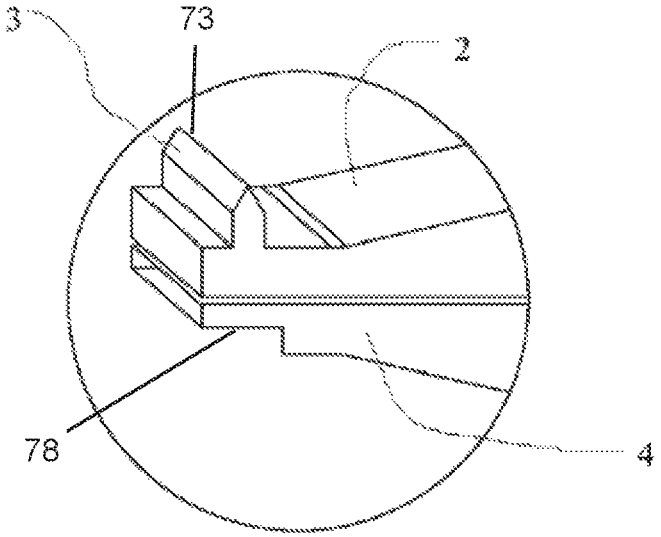
FIG. 8 is a detail perspective view of the working end of the exemplary embodiment of the present invention, shown in the closed position.
Figure 9:
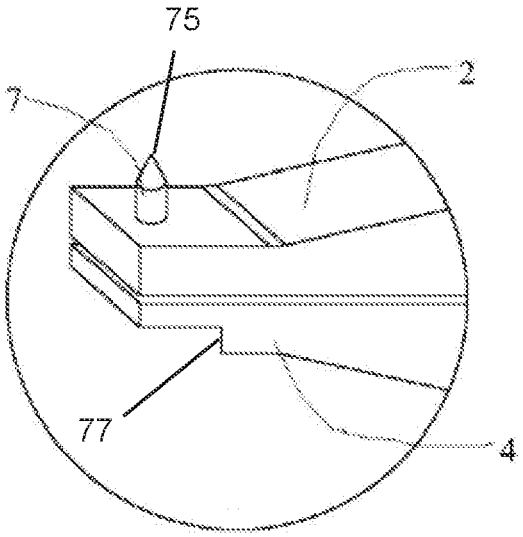
FIG. 9 is a detail perspective view of the working end of the exemplary embodiment of the present invention, shown in the closed position.
Figure 10:
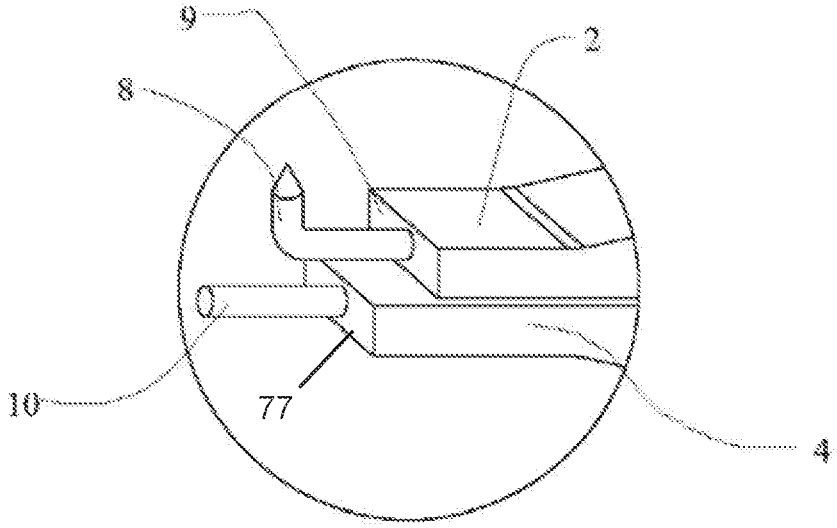
FIG. 10 is a detail perspective view of the working end of the exemplary embodiment of the present invention, shown in the closed position.
Figure 11:
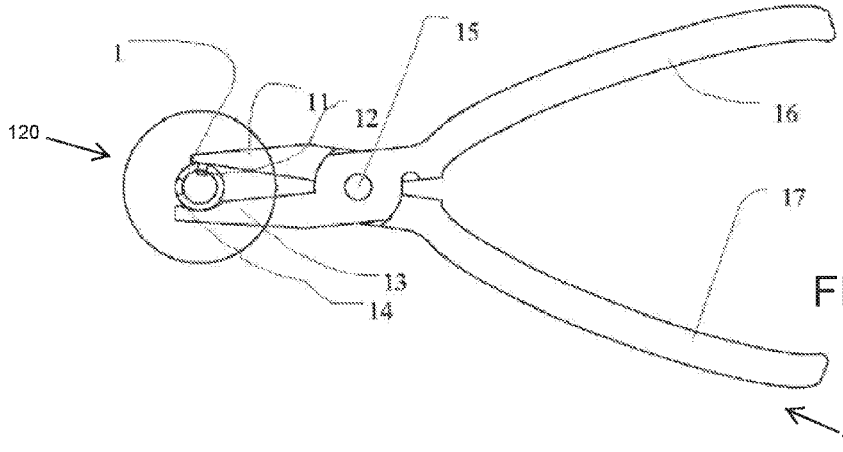
FIG. 11 is a side elevation view of an exemplary embodiment of the present invention, shown in use in an open position.
Figure 12:
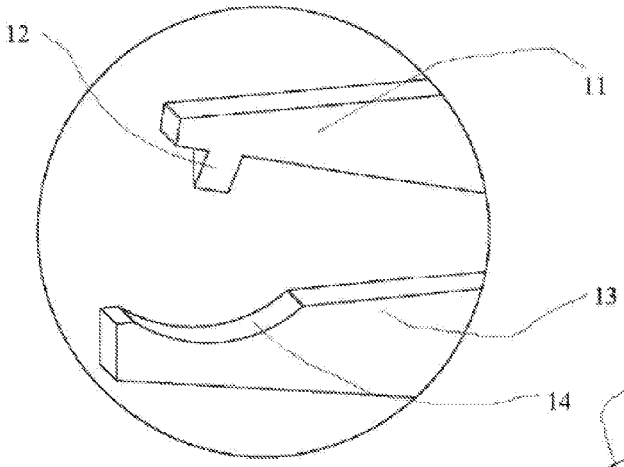
FIG. 12 is a detail perspective view of a working end of the exemplary embodiment of the present invention in the open position.

The upward protrusion 3 may be a continuous fence terminating in the wedge edge 73, as illustrated in FIG. 8, or may be a post terminating in the point 75, as illustrated in FIG. 9. Furthermore, the upward protrusion 3 may be a protruding insert 8 removably attachable to a distal end of the opening jaw 2, having its wedge edge 73 oriented away from the supporting surface 78. Likewise, the supporting surface 78 may be a supporting insert 10 removably attachable to a distal end of the supporting jaw 4. The supporting insert 10 may be many shapes or orientations including but not limited to concaved, U-shaped, V-shaped, concave, horizontal, etc. The supporting surface 78 may be a notch, as illustrated in FIG. 8 or a horizontal rod, as illustrated in FIG. 10, as long as a portion of the supporting jaw 4 provides a supporting wall 77, generally transvers to the supporting surface 78 for further retaining the split ring 1 on the supporting surface 78 during use.

Referring to FIGS. 26 through 29, the first embodiment 110 has handles 37 and 38 providing a pair of opposing jaws 33 and 35, respectfully, pivoting about a pivot point 39. The first embodiment 110 of the hand tool 100 may provide an upward protrusion 34 transversely extending from the opening jaw 33, and a downwardly supporting surface 36 on the supporting jaw 35 facing in an opposite direction of the upward protrusion 33, wherein the pair of opposing jaws 33 and 35 are tapered as illustrated in FIGS. 26 through 29.

Referring to FIGS. 11 through 16, a second embodiment 120 of the hand tool 100 may provide a downward protrusion 12 depending from the opening jaw 11, wherein the downward protrusion 12 terminates in a tapered wedge edge 73 or point 75, and wherein the wedge edge/point 73/75 is adapted to pass between the convolutions of the split ring 1. The supporting jaw 13 provides an upward-facing arcuate supporting surface 14 oriented to face the downward protrusion 12. The second embodiment 120 arranges the pair of elongated handles 16 and 17 to be pivotally interconnected between their opposite ends by a pivot pin 15 establishing an axis for relative pivotal movement of the handles 16 and 17. The handles 16 and 17 provide the pair of jaws 13 and 11, respectfully.

The second embodiment 120 arranges the pair of jaws so that they approach the split ring 1 from an outer or outside diameter thereof allowing a greater range of split ring 1 diameters and wire gauges that can be more easily accommodated than provided by the prior art. Movement of said jaws is conducted by the opening jaw handle 17 cooperating with the supporting jaw handle 16 via the pivot pin 15. The second embodiment 120 needs only one jaw, opening jaw 11, at the split ring manipulation point/convolution eye. As a result, the second embodiment 120 does not have the probe limitations that the prior art conjoining jaws generate.

Figure 13:
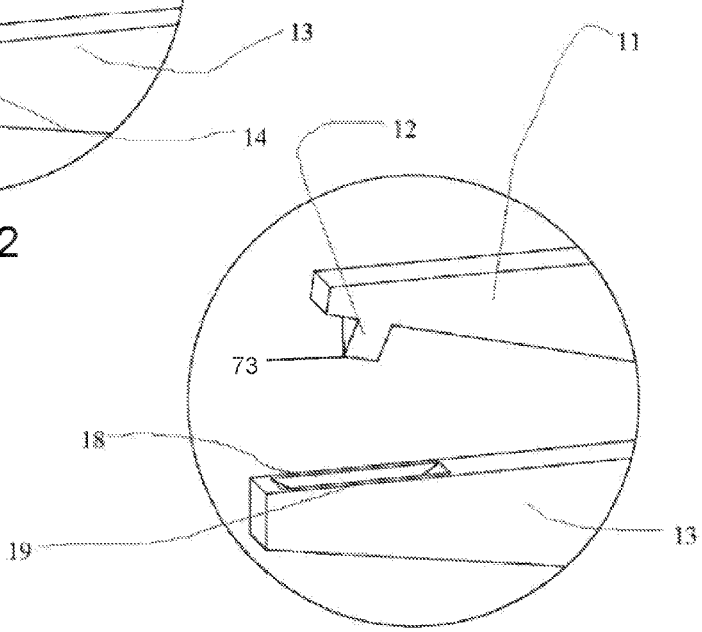
FIG. 13 is a detail perspective view of the working end of the exemplary embodiment of the present invention in the open position.
Figure 14:
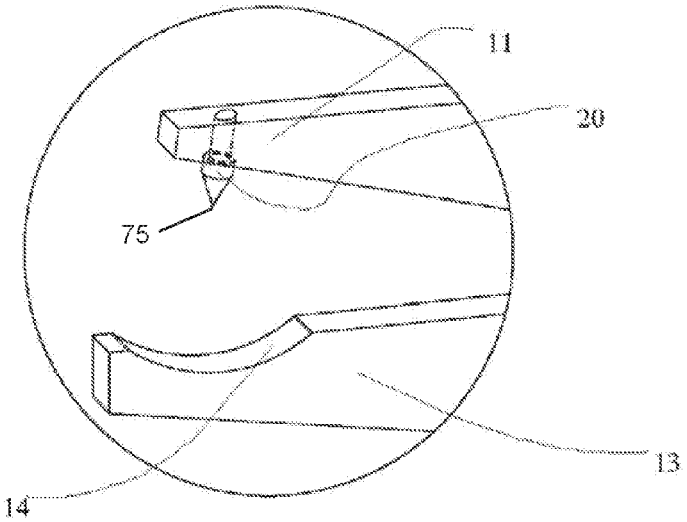
FIG. 14 is a detail perspective view of the working end of the exemplary embodiment of the present invention in the open position.
Figure 15:
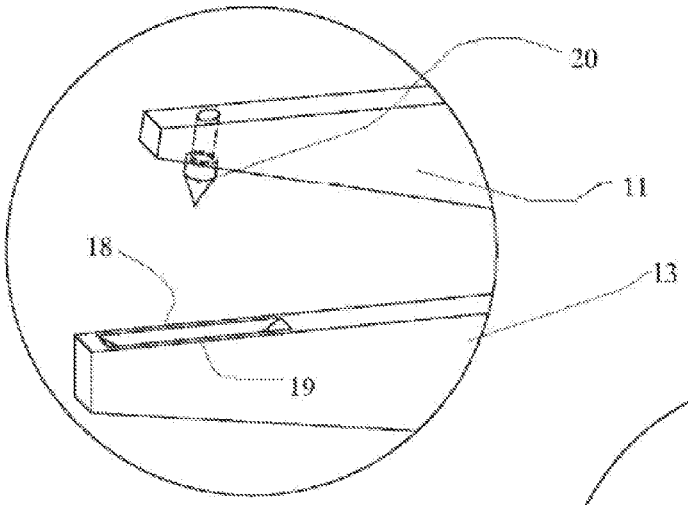
FIG. 15 is a detail perspective view of the working end of the exemplary embodiment of the present invention in the open position.
Figure 16:
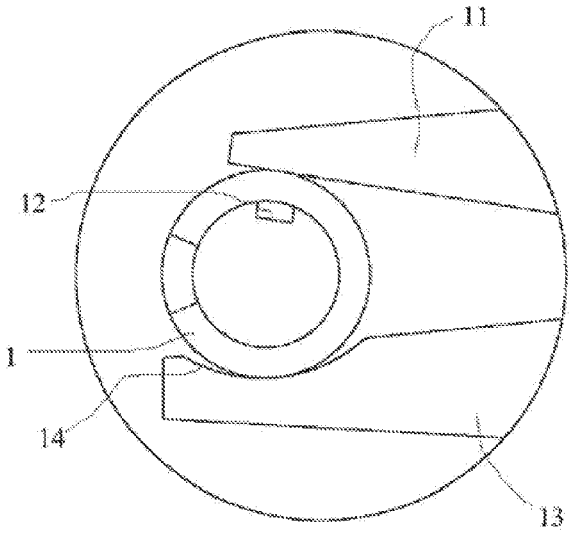
FIG. 16 is a detail side elevation view of the working end of the exemplary embodiment of the present invention in the open position shown in use.
Figure 17:
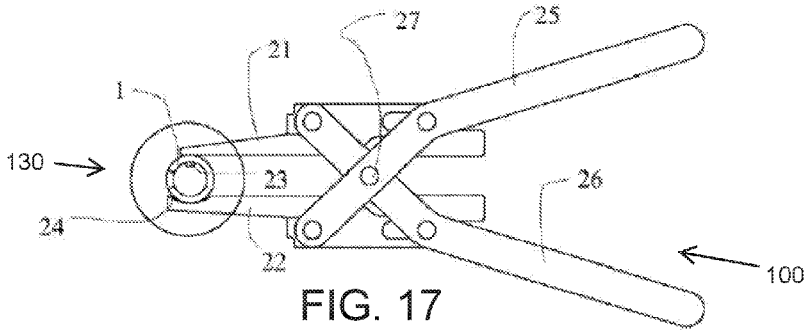
FIG. 17 is a side elevation view of an exemplary embodiment of the present invention, shown in use in an open position.
Figure 18:
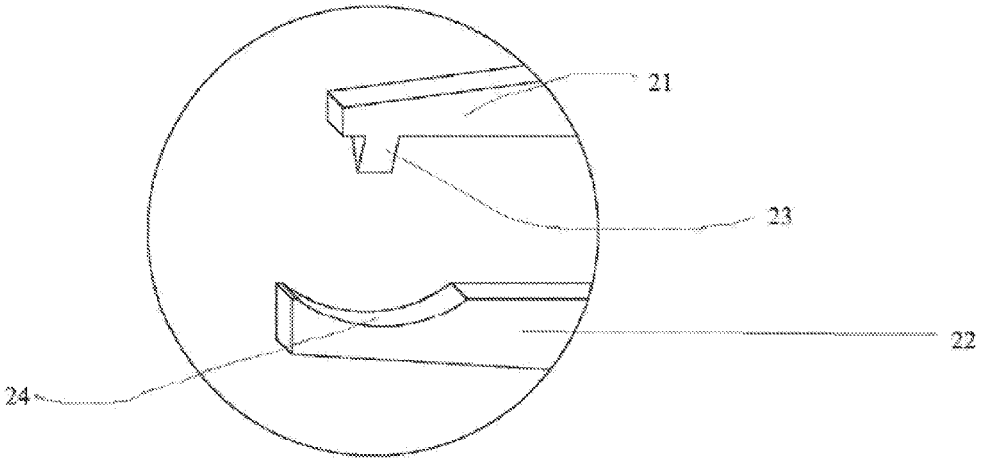
FIG. 18 is a detail perspective view of the working end of the exemplary embodiment of the present invention in the open position.
Figure 19:
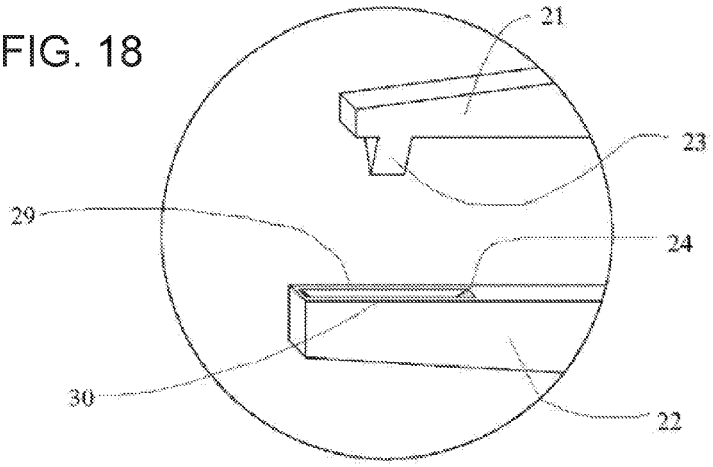
FIG. 19 is a detail perspective view of the working end of the exemplary embodiment of the present invention in the open position.
Figure 20:
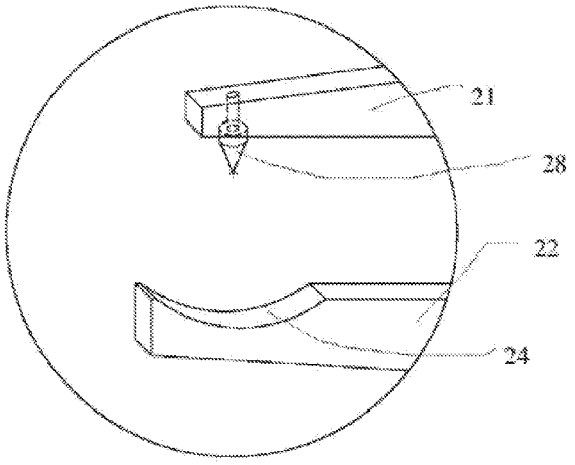
FIG. 20 is a detail perspective view of the working end of the exemplary embodiment of the present invention in the open position.
Figure 21:
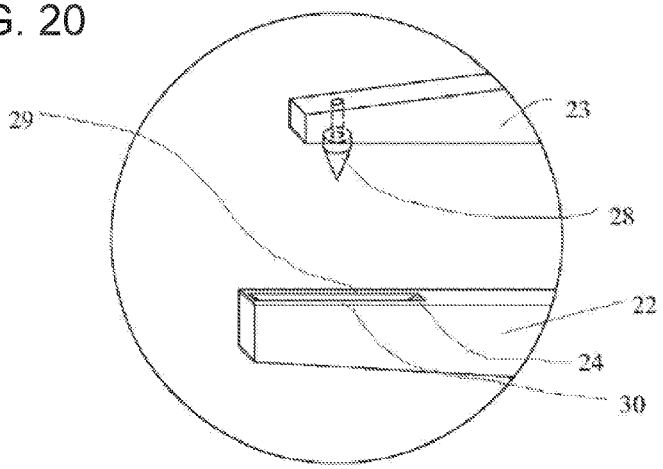
FIG. 21 is a detail perspective view of the working end of the exemplary embodiment of the present invention in the open position.
Figure 22:
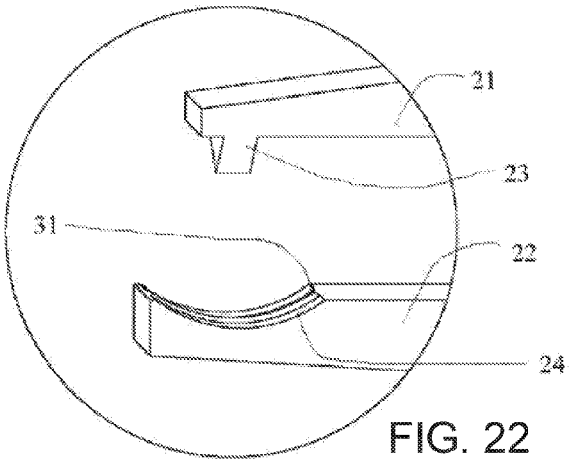
FIG. 22 is a detail perspective view of the working end of the exemplary embodiment of the present invention in the open position.
Figure 23:
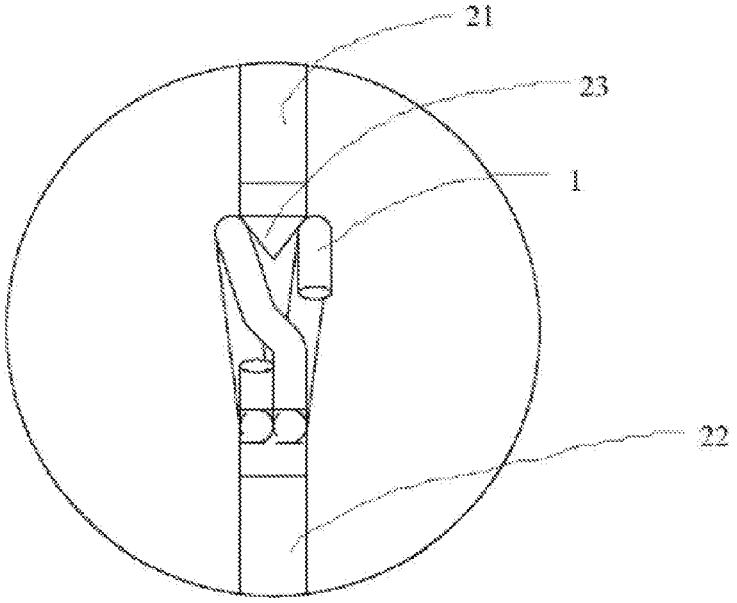
FIG. 23 is a detail front elevation view of the working end of the exemplary embodiment of the present invention shown in use in the open position.
Figure 24:
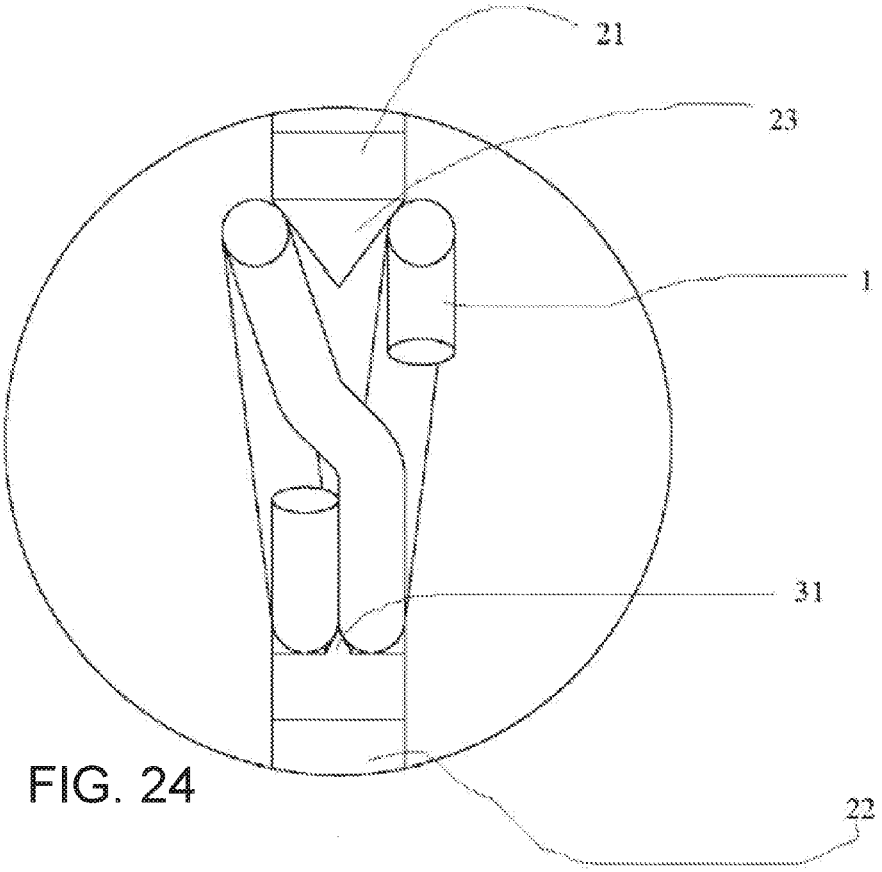
FIG. 24 is an enlarged detail view of FIG. 23.
Figure 25:
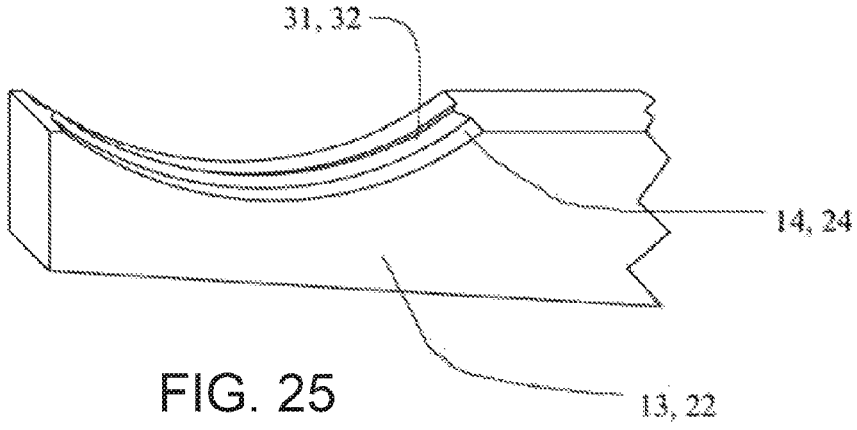
FIG. 25 is a detail perspective view of a lower portion of the working end of the exemplary embodiment of the present invention.
Figure 26:
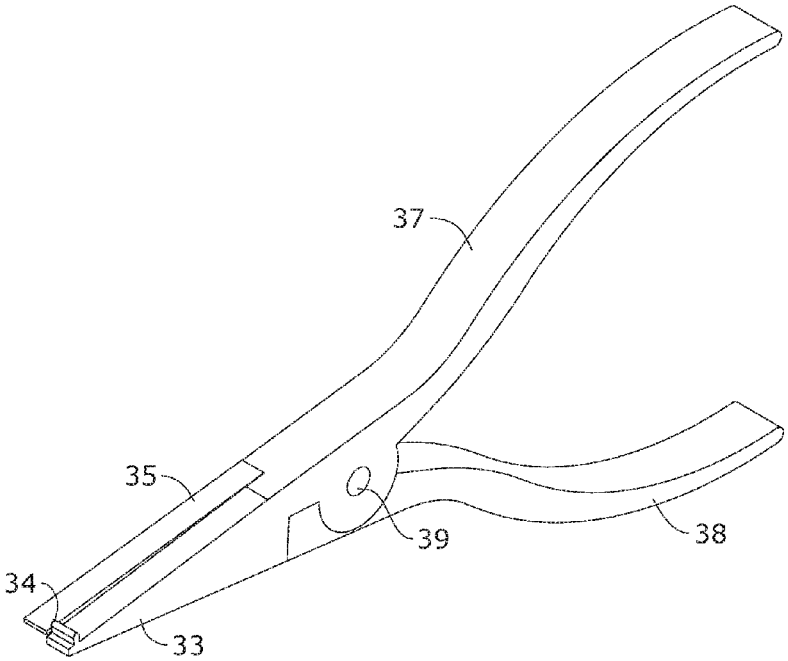
FIG. 26 is a perspective view of an exemplary embodiment of the present invention in the closed position.
Figure 27:
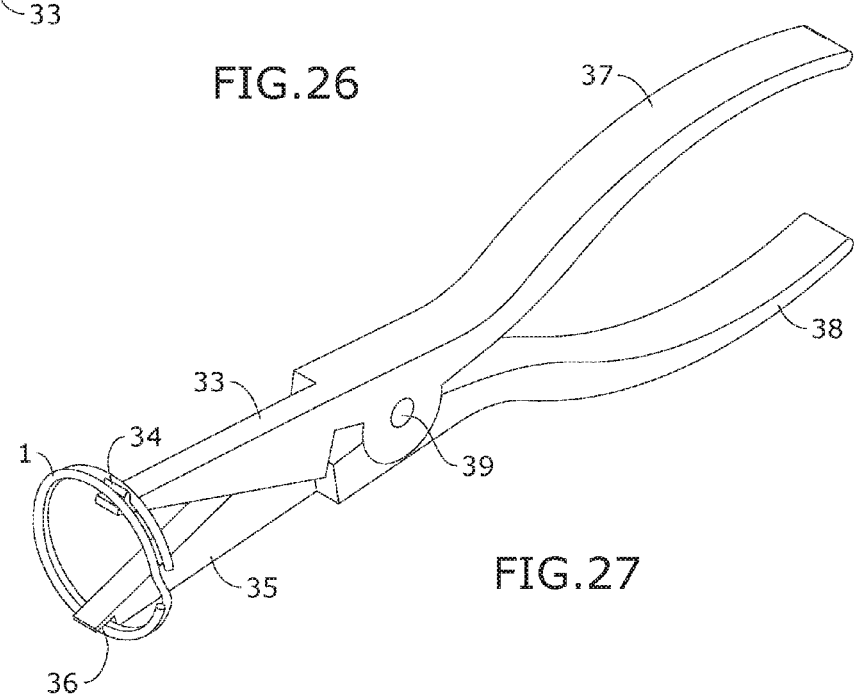
FIG. 27 is a perspective view of an exemplary embodiment of the present invention in use in the open position.
Figure 28:
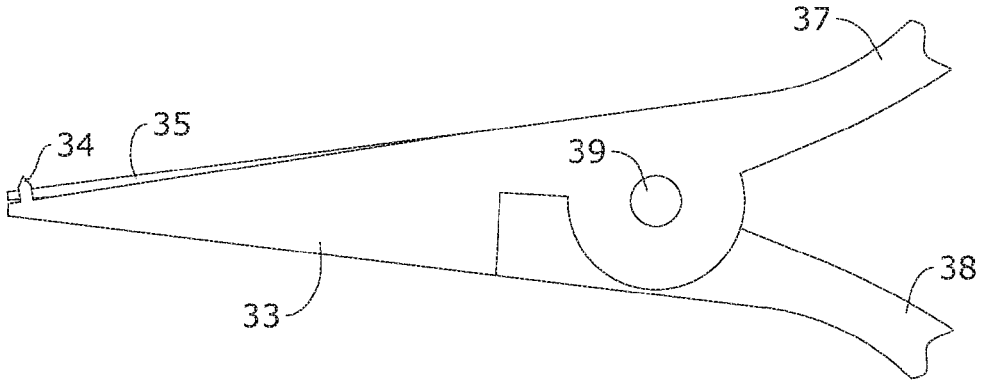
FIG. 28 is a side elevation view of an exemplary embodiment of the present invention in the closed position.
Figure 29:
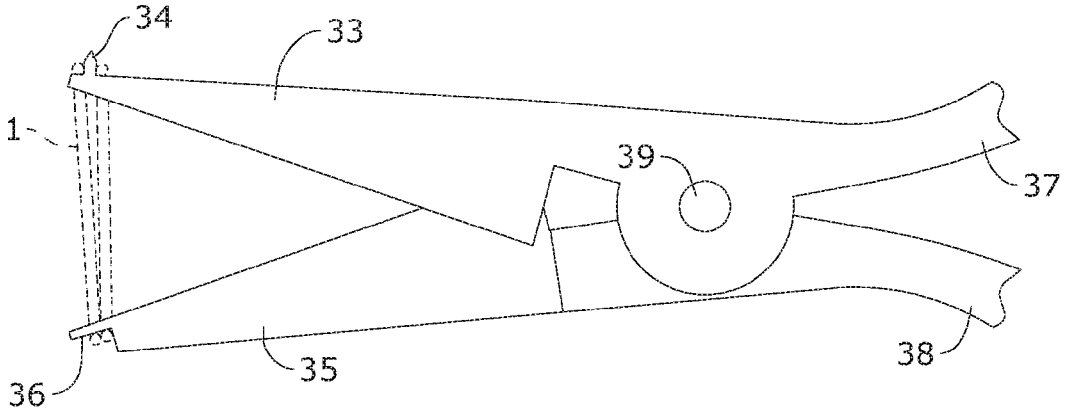
FIG. 29 is a side view of an exemplary embodiment of the present invention in use in the open position.

The arcuate supporting surface 14 may be recessed within the supporting jaw 13, and as a result have opposing bookending walls 18 and 19, as illustrated in FIG. 13. The downward protrusion 12 may be provided through an insert 20 adapted to removably attach to the opening jaw 11, as illustrated in FIGS. 14 and 15. Referring to FIGS. 17 through 25, a third embodiment 130 of the hand tool 100 may provide a downward protrusion 23 depending from the opening jaw 21, wherein the downward protrusion 23 terminates in a tapered wedge edge 73 or point 75, and wherein the wedge edge/point 73/75 is adapted to pass between the convolutions of the split ring 1. The supporting jaw 22 provides an upward-facing arcuate supporting surface 24 oriented to face the downward protrusion 23. The arcuate supporting surface 24 may be recessed within the supporting jaw 22, and as a result have opposing bookending walls 29 and 30, as illustrated in FIG. 19. The arcuate supporting surface 24 may provide a circumferential ridge 31, 32 generally centrally disposed along the arcuate supporting surface 24, as illustrated in FIG. 25. The circumferential ridge 31, 32 is dimensioned and adapted to wedge into the convolution eye, and thus support the split ring 1 during use, as illustrated in FIG. 24. The circumferential ridge 31, 32 may also be present in the arcuate supporting surface 24 of the second embodiment 120. The downward protrusion 23 may be provided through an insert 20 adapted to removably attach to the opening jaw 21, as illustrated in FIGS. 20 and 21.

Figures 32A, 32B:
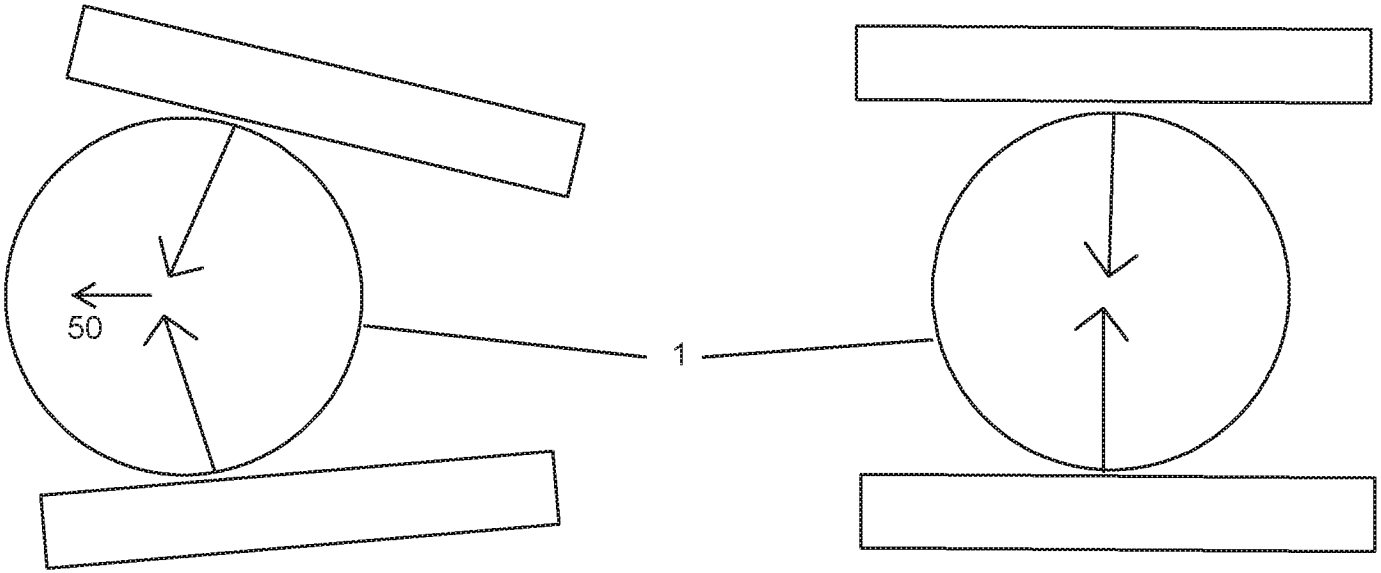
FIG. 32A is a schematic view of a tangentially loaded split ring resulting in a squirt vector.
FIG. 32B is a schematic view of the diametrically loaded split ring probe.

The third embodiment 130, like the second embodiment 120, is arranged to approach the split ring 1 from an outer or outside diameter. The third embodiment 130, unlike the second embodiment, provides parallel pivot action of its pivot point 27 and handles 25 and 26. The use of a parallel action further improves the efficacy of this embodiment since the pressure vectors on the outer diameter of the split ring 1 by the two jaws is diametrically opposing. Jaws, in contrast, which are tangent to the split ring 1 but not fully opposing make it easier for the split ring 1 to escape the jaws during closing. Referring to FIGS. 32A and 32B, wherein FIG. 32A illustrates the jaws applying forces that are not parallel to each other, and thus a resulting "squirt vector" 50 urging the split ring 1 to escape the jaws. In contrast, the diametrically opposing force of the parallel pivot action jaws increase the securement of the split ring in place during use.

A method of using the present invention may include the following. The hand tools 100 disclosed above may be provided. The first embodiment tool 110 works by expanding the opening and supporting jaws 2 and 4 from their closed position such that they engage the inside diameter of the split ring 1. The user may locate the tool 110 such that as the jaws expand, the opening jaw 2 is proximately located at a convolution eye of the split ring convolutions. The protruded feature 3 inserts itself between split ring convolution eye generating a gap in the area proximate to the convolution eye. The amount of gap is a function of the architecture of the protruding feature 3 and the amount of travel of said feature which is a product of the pressure exerted on the jaw handles 5 and 6. When a satisfactory gap has been generated items may be added, removed or modified and upon completion of the desired manipulation the tool is removed from the split ring 1.

The second embodiment of the tool 120 engages solely the outside diameter of said split ring 1. The jaws 21, 22 are manipulated such they engage the outside diameter of the split ring 1. The operator locates the tool such that as the jaws close on the outside diameter, the opening jaw 21 is proximately located to an eye of the split ring convolutions. The protruded feature 12 inserts itself between split ring convolutions generating a gap in the area proximate to the convolution eye. The amount of gap is a function of the architecture of the protruding feature and the amount of travel of said feature which is a product of the pressure exerted on the jaw handles. When a satisfactory gap has been generated items may be added, removed or modified and upon completion of the desired manipulation the tool 120 is removed from the split ring 1.

The third embodiment 130 is similar to the second embodiment 120 of the outside diameter tool, though features parallel action by the jaws. All outside diameter tools 120/130 may be enhanced by a recess 14, 24, recess walls 18, 19/29, 30 and a protruding feature 31,32 located in said recess. These features greatly enhance the tool's manipulation of said split rings. The tools may feature a manner of locking the handles or jaws in a selected position and a provision made to insert one or both handles in a stand so as to free both hands for manipulation. Furthermore, the present invention could be incorporated into a machine instead of a tool permitting split ring manipulation in a manner similar to that of the tool of the invention. The various embodiments would be grasped and the handles operated while addressing the split ring permitting the jaws to create the gap at the eye of the split ring convolution so that said split ring can be manipulated.

Figure 30A:
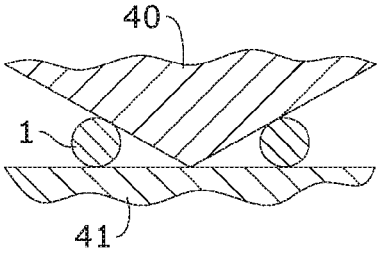
FIG.30A (PRIOR ART)
FIG. 30A is a front section view of a flat probe of an exemplary prior art shown in use in a closed position.
Figure 31A:
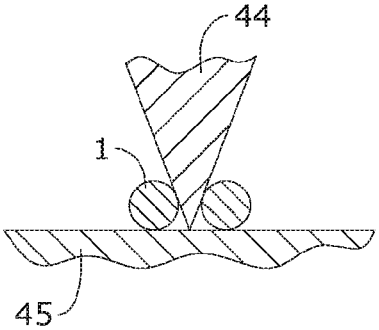
FIG.31A (PRIOR ART)
FIG. 31A is a front section view of an acute probe of an exemplary prior art shown in use in a closed position.
Figure 30B:
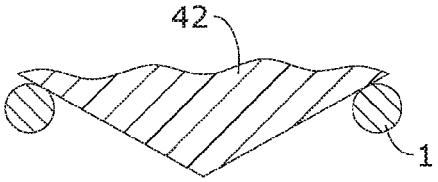
FIG. 30B is a front section view of a flat probe of an exemplary embodiment of the present invention shown in use in a closed position.
Figure 31B:
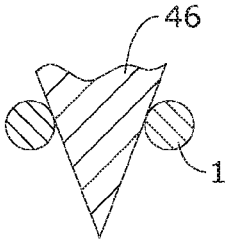
FIG. 31B is a front section view of an acute probe of an exemplary embodiment of the present invention shown in use in a closed position.
Figure 30C:
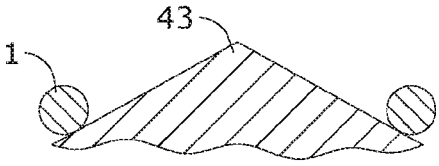
FIG. 30C is a front section view of the flat probe of an exemplary embodiment of the present invention shown in use in the closed position.
Figure 31C:
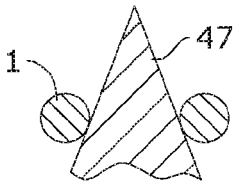
FIG. 31C is a front section view of the acute probe of an exemplary embodiment of the present invention shown in use in the closed position.

Referring to FIGS. 30A through 31C, the prior art dealing with split ring operation is much less effective than the present invention. The range and versatility of the tools in the prior art are substantially limited by the combination of the specific physical characteristics of the probe operating in the travel range allowed by the jaws moving from the open to closed position, by the requirement that both jaws be present to manipulate the split ring. Furthermore, as shown in FIGS. 30A and 31A, the prior art flat and acute probes 40 and 44, respectively, are halted at the supporting surfaces of the opposing supporting jaws, 41 and 45, respectively. As the flat and acute probes/protrusions/protruding features 42, 43, 73 and 46, 47, 75, respectfully of the present invention is not limited by contact with the opposing jaw, it is capable of significantly greater convolution penetration and resulting gap generation than probes of similar size and architecture found in the prior art, as illustrated in FIGS. 30B, 30C, 31B, and 31C. In addition, the prior split ring supports and notches require additional dexterity on the part of the operator that are alleviated by the present invention, especially given the variety of rings used in constructing terminal fishing tackle these limitations are significant. Further in the prior art both jaws are required to manipulate the convolutions of the split ring. The present invention in all embodiments requires the presence of only one jaw at the point of manipulation. Further, all embodiments of the present invention operate over a wider range for a given probe size and architecture since, with only one jaw involved in actual manipulation, whereby there is no limitation of probe operation and travel due to conjoining of the jaws. The prior art restricts probe travel from the open position to the conjoining of the cooperating jaws. Since only one jaw is required for manipulation by all embodiments of the present invention tool interference with manipulation is reduced by fifty percent compared to the prior art. And when the manipulating top jaw is at the underside of the eye of the split ring convolution, tool interference is negligible.

Furthermore, in all embodiments—whether working from the inner or outer diameter—as only one jaw is near the convolution eye there is at least fifty percent more room for fingers to manipulate objects on the split ring convolutions.

Accordingly, tool interference with manipulation is halved. In the third embodiment 130, employing the parallel plier configuration, the range of split ring diameters efficiently accommodated is greatly increased as the tangent angle of the jaws to the split ring are parallel rather than acute. In the second and third embodiments 120 and 130, engaging the outer diameter of the split ring 1, the split ring 1 is supported/secured in a least awkward plane while being inserted into the tool. Moreover, the hemispherical recess indentation 14, 24 containing the horizontal recess stabilizing ridge 31 or 32 further secures the split ring 1 in all axes: x, y, and z. And all embodiments can feature a mechanical drag or handle lock to hold tool in a selected position and tool handle could be mounted in a stand to free both hands for manipulation.

It should be understood, of course, that the foregoing relates to exemplary embodiments of the invention and that modifications may be made without departing from the spirit and scope of the invention as set forth in the following claims.

What is claimed is:

1. A device for spreading apart adjacent convolutions of a split ring, comprising:

a pair of jaws which are movable between an open and a closed position;

one of said jaws having a supporting surface; and the other of said jaws having a protrusion with a wedge edge or point adapted as the jaws are moved from the closed to the open position to pass between the convolutions of a split ring engaging the supporting surface, wherein the pair of jaws occupy a position in an opening of the split ring engaged by the supporting surface.

2. The device of claim 1, further comprising a supporting wall defined by the one of said jaws so that the supporting wall is generally perpendicular to the supporting surface.

3. The device of claim 1, wherein the supporting surface is removably attachable to the one of said jaws.

4. The device of claim 1, wherein the protrusion faces away from a center of said opening.

5. A method of spreading apart adjacent convolutions by using the device of claim 1, comprising the steps of:

placing the pair of jaws within said opening;

securing the split ring by moving said jaws toward the open position until the supporting surface engages and the protrusion engage generally opposing portions of an inner diameter of the opening; and moving said jaws further to the open position so that the wedge edge or point passes between the adjacent convolutions of the split ring.

6. A device for spreading apart adjacent convolutions of a split ring, comprising:

a pair of jaws which are movable between an open and a closed position;

one of said jaws having an arcuate supporting surface; and the other of said jaws having a protrusion with a wedge edge or point adapted as the jaws are moved from the open to the closed position to pass between the convolutions of a split ring supported on the supporting surface.

7. The device of claim 6, further comprising sidewalls defined by the arcuate supporting surface recessed in the one of said jaws.

8. The device of claim 6, further comprising a circumferential ridge protruding from the arcuate supporting surface, wherein the circumferential ridge is adapted to encounter a convolution eye of the split ring supported thereon.

9. The device of claim 6, wherein the pair of jaws move with a parallel pivot action so that in the protrusion and the supporting surface are oriented in a collinear relationship with each other in both the open and the closed position.

* * * * *